US006682462B1

(12) United States Patent
Lee

(10) Patent No.: US 6,682,462 B1
(45) Date of Patent: Jan. 27, 2004

(54) DUAL-PURPOSE EXERCISER OPERABLE IN PEDALING AND ROWING MODES

(76) Inventor: Sunny Lee, No. 257-8, Chung-Cheng Rd., Tsao-Tun Chen, Nan-Tou Hsien (TW)

( * ) Notice: Subject to any disclaimer, the term of this patent is extended or adjusted under 35 U.S.C. 154(b) by 0 days.

(21) Appl. No.: 10/371,523

(22) Filed: Feb. 21, 2003

(51) Int. Cl.[7] ..... A63B 69/06
(52) U.S. Cl. ..... 482/72; 482/62
(58) Field of Search ..... 482/51, 52, 57, 482/70, 72, 62, 63, 60

(56) References Cited

U.S. PATENT DOCUMENTS 4,850,587 A * 7/1989 Lin ..... 482/72
5,072,929 A * 12/1991 Peterson et al. ..... 482/72
5,961,423 A * 10/1999 Sellers ..... 482/57
6,080,088 A * 6/2000 Petersen et al. ..... 482/72
6,361,479 B1 * 3/2002 Hildebrandt et al. ..... 482/72

* cited by examiner

*Primary Examiner*—Stephen R. Crow
(74) *Attorney, Agent, or Firm*—Ladas & Parry

(57) ABSTRACT

A dual-purpose exerciser includes an axle mounted on a frame section, a pair of pedal units coupled to the axle, and a drive wheel connected to the axle through a first one-way clutch such that the drive wheel is rotatable with the axle in a certain direction. A drive belt is trained on the drive wheel and a resistance wheel. A pull wheel on the axle is connected to the drive wheel through a second one-way clutch such that the pull wheel can drive rotation of the drive wheel. A pull rope is secured to the pull wheel.

10 Claims, 11 Drawing Sheets

DUAL-PURPOSE EXERCISER OPERABLE IN PEDALING AND ROWING MODES

BACKGROUND OF THE INVENTION

1. Field of the Invention

The invention relates to an exerciser, more particularly to a dual-purpose exerciser operable in pedaling and rowing modes.

2. Description of the Related Art

As shown in FIG. 1, a conventional rowing-type exerciser includes a frame unit 1 and a drive unit 2. The frame unit 1 has a pair of foot rests 101 (only one is visible) mounted fixedly and respectively on lateral sides of a front section thereof, and a seat 102. The drive unit 2 includes a first belt wheel 201 mounted rotatably on the frame unit 1, a rope wheel 202 mounted coaxially on the first belt wheel 201, a resistance wheel 203 mounted rotatably on the frame unit 1, and a second belt wheel 2031 mounted coaxially on the resistance wheel 203. The second belt wheel 2031 is smaller than the first belt wheel 201. A drive belt 204 is trained on the first and second belt wheels 202, 2031. A pull rope 205 is wound on the rope wheel 202, and a pull handle 206 is connected to one end of the pull rope 205. During operation, the user sits on the seat 102 with his two feet placed on the foot rests 101. Thereafter, the user pulls the pull handle 206 to drive the rope wheel 202 through the pull rope 205 such that the first belt wheel 201 is enabled to transmit power to the resistance wheel 203 through the drive belt 204 and the second belt wheel 2031, thereby resulting in an exercising effect by virtue of a rowing motion.

As shown in FIG. 2, a conventional pedaling-type exerciser includes a frame unit 3 and a drive unit 4. The frame unit 3 has a seat 301 mounted thereon. The drive unit 4 includes a drive axle 401 mounted rotatably on the frame unit 3, a pair of pedal units 402 (only one is visible) coupled to opposite ends of the drive axle 401, a first belt wheel 403 mounted on the drive axle 401, and a second belt wheel 4041 mounted rotatably on the frame unit 3. The second belt wheel 4041 is smaller than the first belt wheel 403. A resistance wheel 404 is mounted coaxially on the second belt wheel 4041. A drive belt 405 is trained on the first and second belt wheels 403, 4041. During operation, the user sits on the seat 301 with his two feet placed on the pedal units 402. Thereafter, the pedal units 402 can be operated so as to drive the first belt wheel 403 to transmit power to the resistance wheel 404 through the drive belt 405 and the second belt wheel 4041, thereby resulting in an exercising effect by virtue of a pedaling motion.

It is noted that each of the aforesaid conventional exercisers only permits one of a rowing exercising effect and a pedaling exercising effect.

SUMMARY OF THE INVENTION

Therefore, the main object of the present invention is to provide a dual-purpose exerciser operable in pedaling and rowing modes.

Accordingly, a dual-purpose exerciser of this invention comprises:

an elongate frame unit having a front frame section with front and rear ends, and a rear frame section with front and rear ends, the front end of the rear frame section being connected to the rear end of the front frame section;

a seat mounted on the rear frame section;

an axle mounted rotatably on the front frame section;

a pair of pedal units, each of which has a crank arm coupled to a respective end of the axle, the pedal units being operable so as to drive axial rotation of the axle;

a drive wheel;

a first one-way clutch interconnecting the drive wheel and the axle such that rotation of the axle in a first direction results in corresponding rotation of the drive wheel in the first direction, and such that the axle is incapable of driving rotation of the drive wheel when the axle rotates in a second direction opposite to the first direction;

a resistance wheel mounted rotatably on the front frame section;

a drive belt trained on the drive wheel and the resistance wheel such that rotation of the drive wheel is transmitted to the resistance wheel;

a pull wheel mounted rotatably on the axle;

a second one-way clutch interconnecting the pull wheel and the drive wheel such that rotation of the pull wheel in the first direction results in corresponding rotation of the drive wheel in the first direction, and such that the pull wheel is incapable of driving rotation of the drive wheel when the pull wheel rotates in the second direction;

a pull rope wound on the pull wheel and secured to the pull wheel at one end, wherein pulling of the pull rope to unwind the pull rope from the pull wheel drives rotation of the pull wheel in the first direction; and a restoring unit connected to the pull wheel for rotating the pull wheel in the second direction to wind the pull rope on the pull wheel when the pull rope is released.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
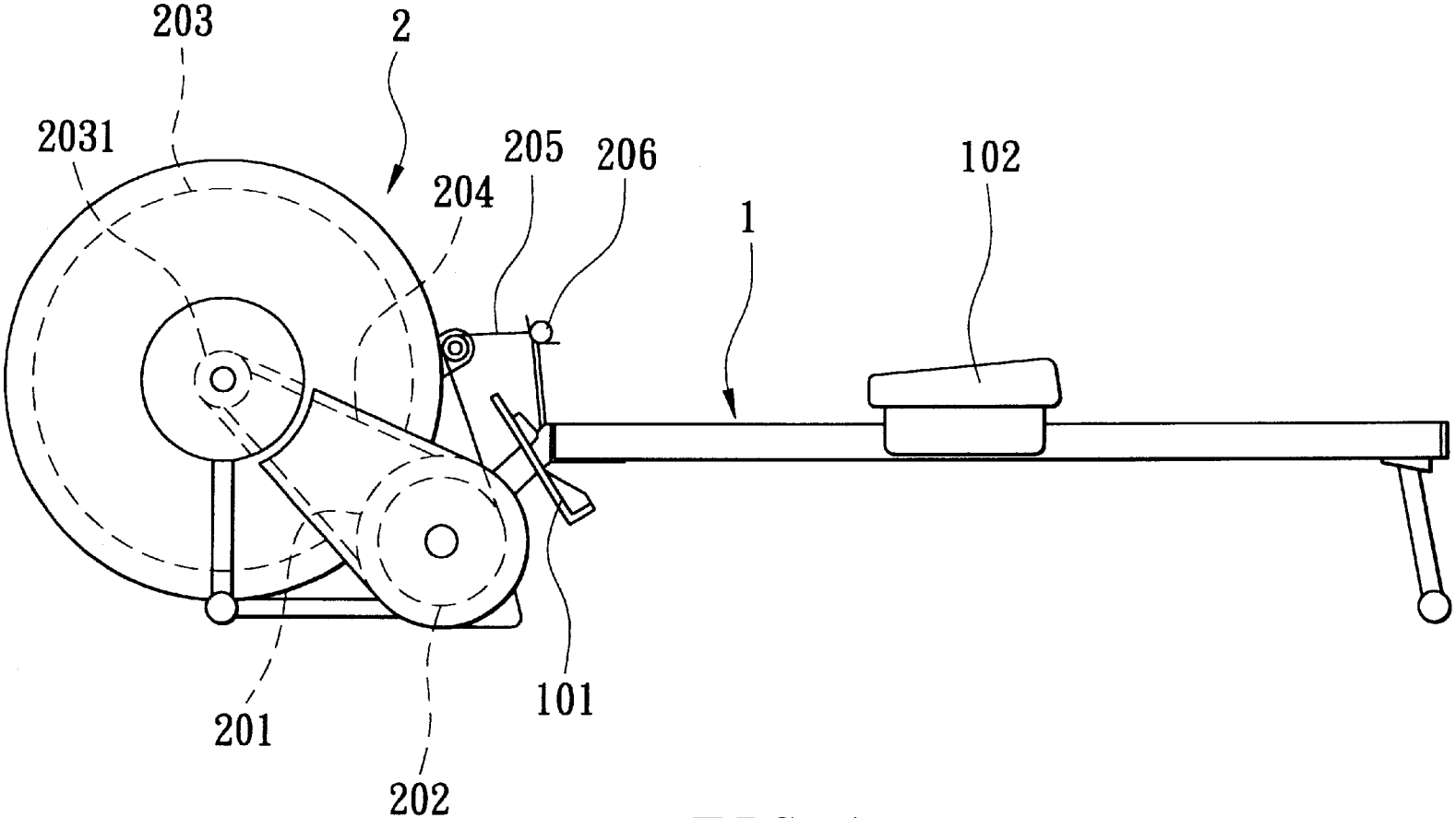
FIG. 1 PRIOR ART
FIG. 1 is a schematic view of a conventional rowing-type exerciser.
Figure 2:
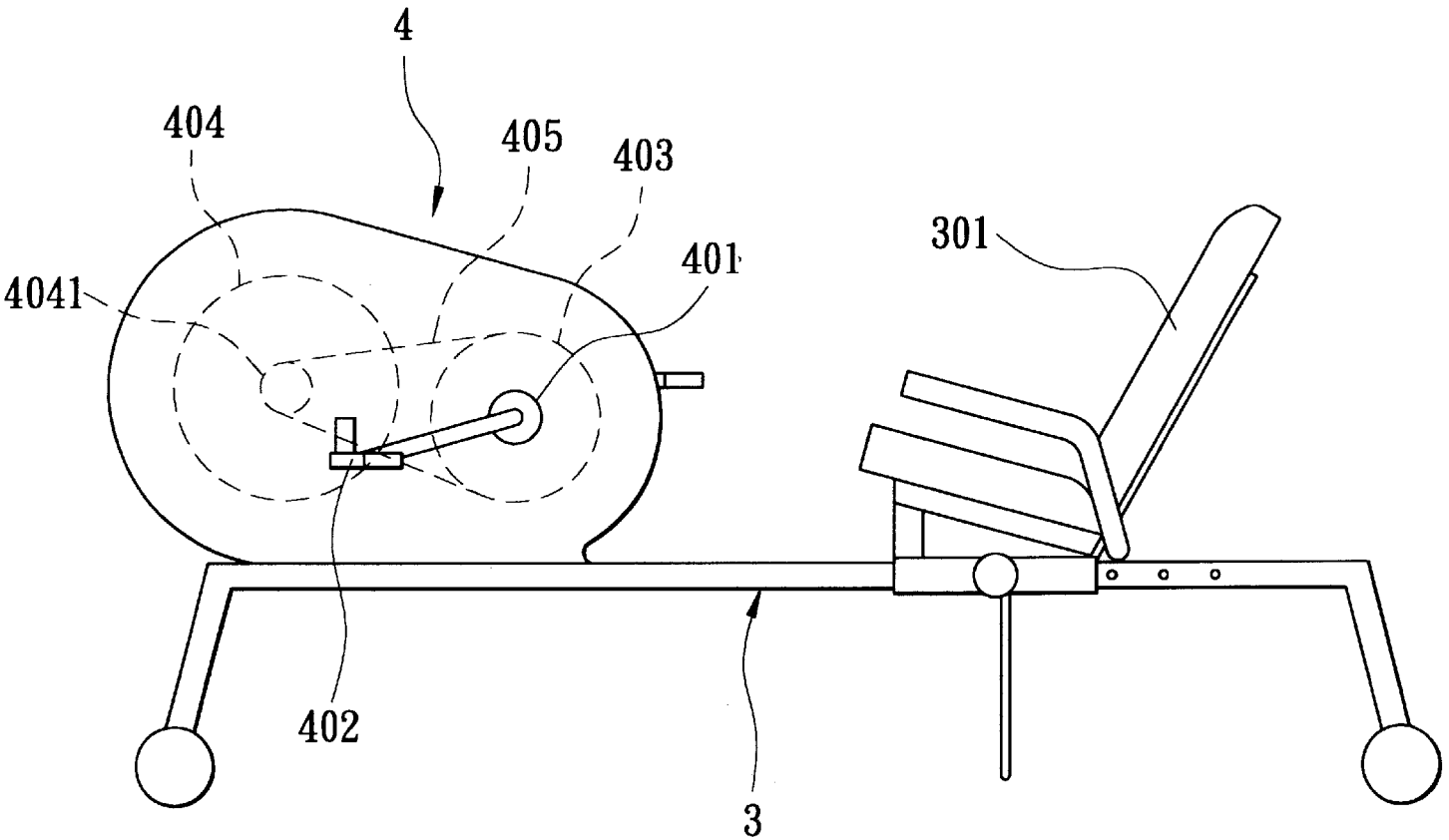
FIG. 2 PRIOR ART
FIG. 2 is a schematic view of a conventional pedaling-type exerciser.

Referring to FIGS. 3, 4, 5 and 6, the preferred embodiment of a dual-purpose exerciser according to the present invention is shown to include a frame unit 10, a seat 20, an axle 31, a pair of pedal units 32, a drive wheel 36, a first one-way clutch 33, a resistance wheel 37, a drive belt 38, a pull wheel 34, a second one-way clutch 35, a pull rope 421, and a restoring unit.

The frame unit 10 includes a front frame section 11 with front and rear ends, a rear frame section 12 with front and rear ends, a fastener unit 13, and a rear leg unit 14. The front end of the rear frame section 12 is connected foldably to the rear end of the front frame section 11. The rear leg unit 14 is connected to the rear end of the rear frame section 12.

The front frame section 11 includes a T-shaped frame member 111, a pair of angled support members 112, an upright post 113, a connecting plate 114, a connecting rod 115, a pair of upright plates 116, a pair of foot rests 117, and a pair of pivot lugs 118 (only one is visible in the drawings). Each of the support members 112 has a lower end mounted on a respective lateral side of a front end of the frame member 111. The upright post 113 has a lower end mounted adjacent to a rear end of the frame member 111. The connecting plate 114 interconnects upper ends of the support members 112. The connecting rod 115 interconnects the connecting plate 114 and an upper end of the upright post 113. Each of the upright plates 116 has a lower end secured to a respective lateral side of the frame member 111 and is disposed rearwardly of a respective one of the support members 112. The foot rests 117 are mounted respectively on opposite lateral sides of the upright post 113. The pivot lugs 118 are mounted on the rear end of the frame member 111 and are disposed rearwardly of the upright post 113.

Figure 4:
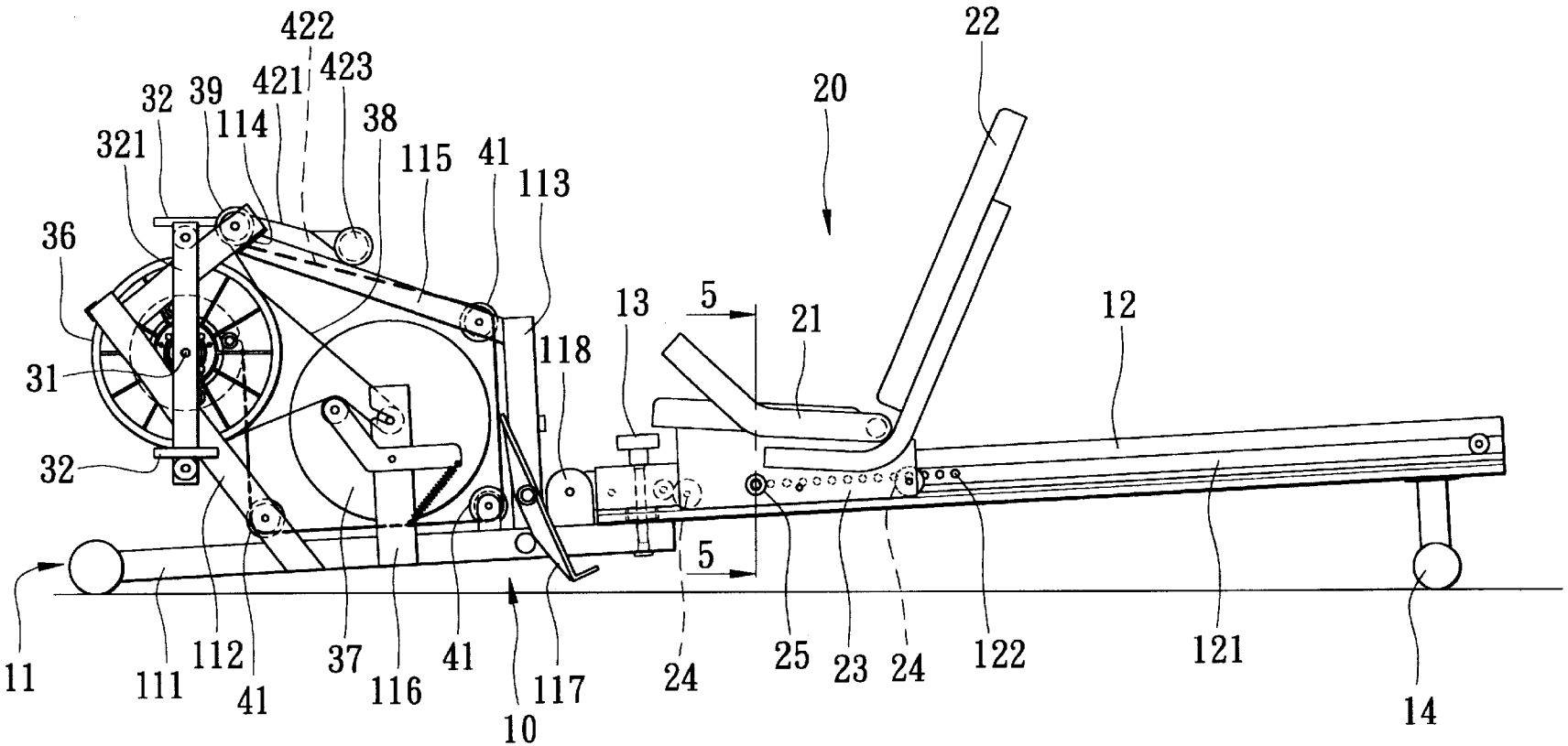
FIG. 4 is a schematic view illustrating the preferred embodiment when a frame unit thereof is at an unfolded state.
Figure 11:
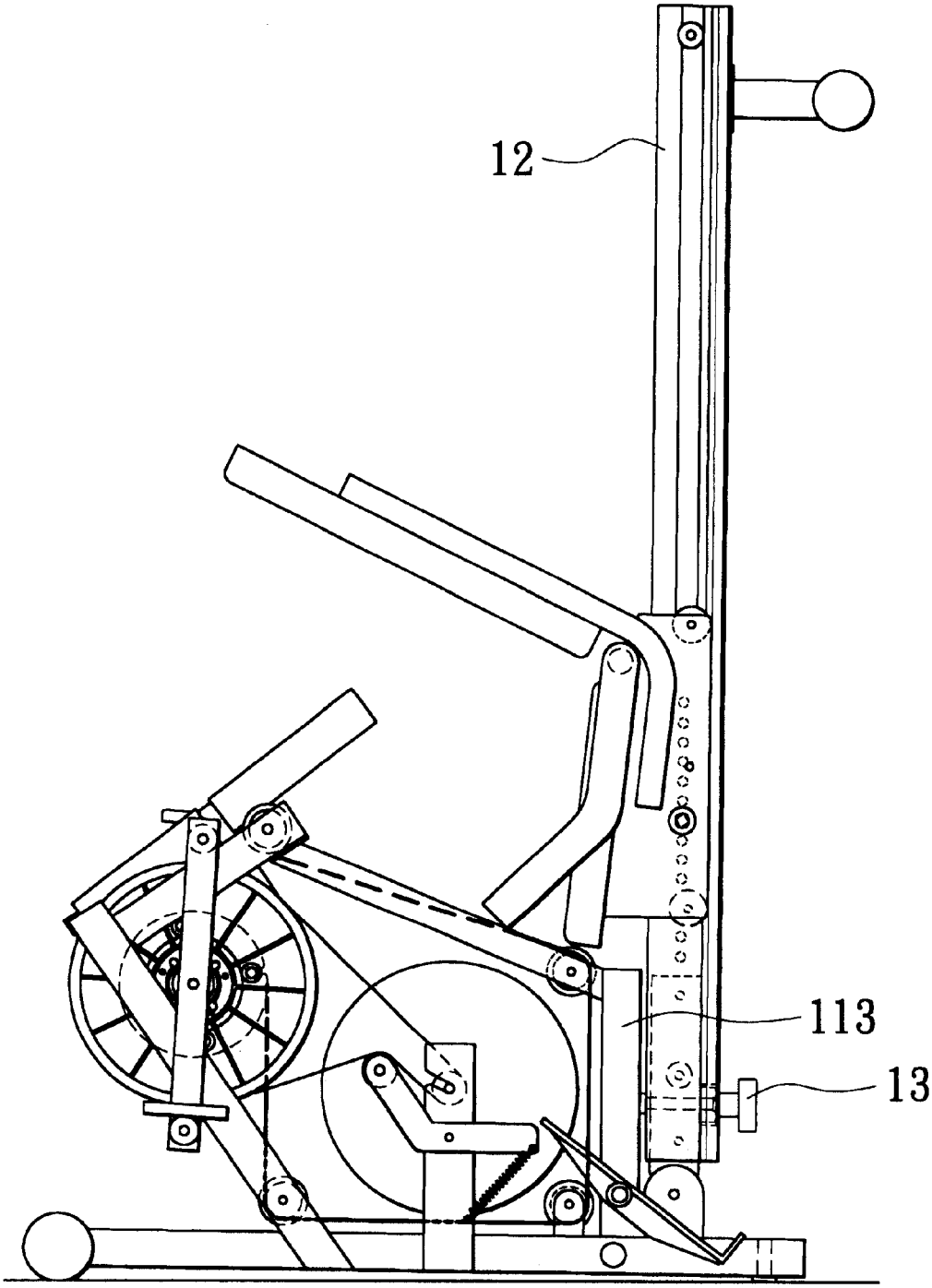
FIG. 11 is a schematic view illustrating the preferred embodiment when the frame unit is at a folded state.

The rear frame section 12 has lateral sides formed with a pair of longitudinally extending rail grooves 121, respectively. One of the rail grooves 121 is formed with a series of positioning holes 122. The front end of the rear frame section 12 is connected pivotably to the pivot lugs 118. The fastener unit 13 fastens releasably the rear frame section 12 to the front frame section 11 at a selected one of unfolded and folded positions. As shown in FIG. 4, when the rear frame section 12 is unfolded, the fastener unit 13 can be applied to fasten the front end of the rear frame section 12 to the rear end of the frame member 111. As shown in FIG. 11, when the rear frame section 12 is folded, the fastener unit 13 can be applied to fasten the front end of the rear frame section 12 to the upright post 113.

Figure 5:
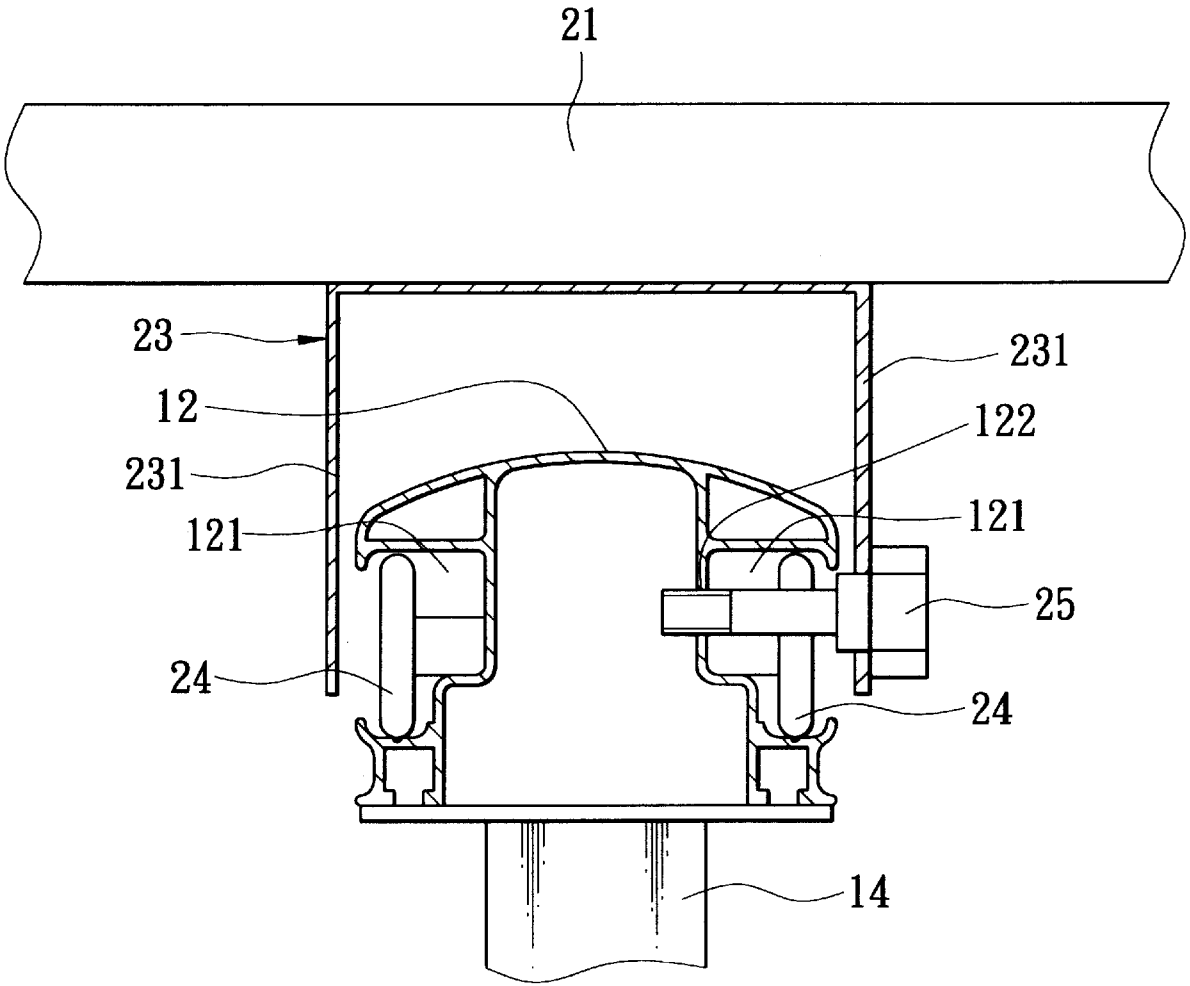
FIG. 5 is a fragmentary cross-sectional schematic view of the preferred embodiment, taken along line 5—5 in FIG. 4.

The seat 20 is mounted on and is slidable along the rear frame section 12, and includes a seat portion 21, and a backrest portion 22 connected to the seat portion 21. With further reference to FIG. 5, a slide frame 23 is mounted on a bottom side of the seat portion 21, and includes a pair of roller-mounting plates 231 that flank the rear frame section 12. Each of the roller-mounting plates 231 is provided with a roller unit 24 that engages a respective one of the rail grooves 121 rollingly. A fastener 25 extends through one of the roller-mounting plates 231 and into a selected one of the positioning holes 122. The fastener 25 cooperates with the positioning holes 122 to constitute a locking unit for locking releasably the seat 20 against sliding movement on the rear frame section 12.

Figure 6:
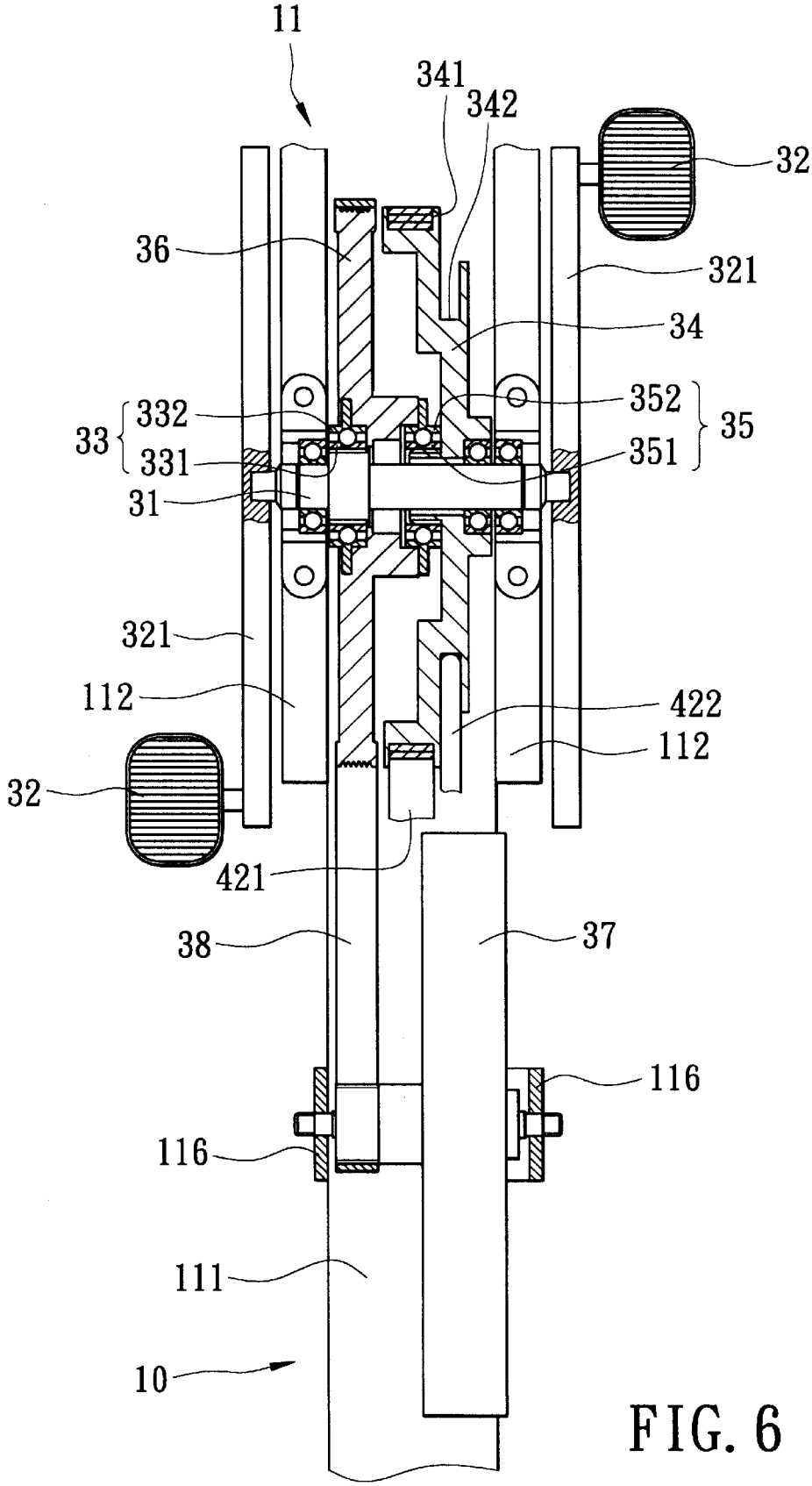
FIG. 6 is a fragmentary, partly sectional, schematic top view of the preferred embodiment.
Figure 7:
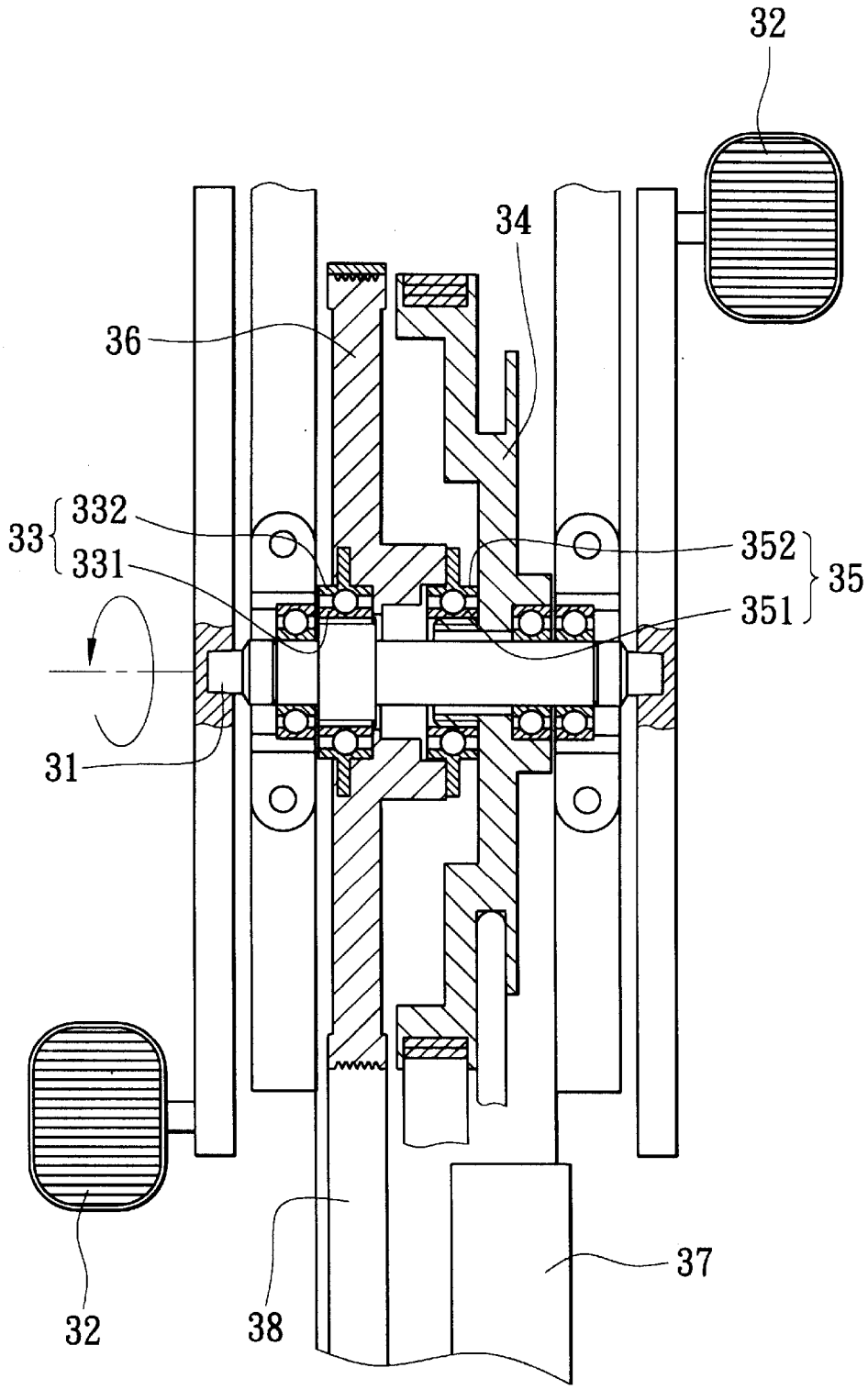
FIG. 7 is a fragmentary, partly sectional, schematic top view of the preferred embodiment to illustrate operation in a pedaling mode.

Referring further to FIG. 6, the axle 31 is mounted rotatably on and extends between the support members 112. Each of the pedal units 32 has a crank arm 321 coupled to a respective end of the axle 31 such that the pedal units 32 are operable so as to drive axial rotation of the axle 31. The drive wheel 36 is mounted coaxially on the axle 31. The first one-way clutch 33 includes an inner race 331 secured to the axle 31, and an outer race 332 secured to the drive wheel 36. Due to the presence of the first one-way clutch 33, rotation of the axle 31 and thus the inner race 331 in a first or counterclockwise direction drives corresponding rotation of the outer race 332 and thus the drive wheel 36 in the first direction, as best shown in FIG. 7, whereas rotation of the inner race 331 in a second or clockwise direction cannot drive rotation of the outer race 332. On the other hand, rotation of the outer race 332 in the second direction drives corresponding rotation of the inner race 331 in the second direction, whereas rotation of the outer race 332 in the first direction cannot drive rotation of the inner race 331.

Figure 9:
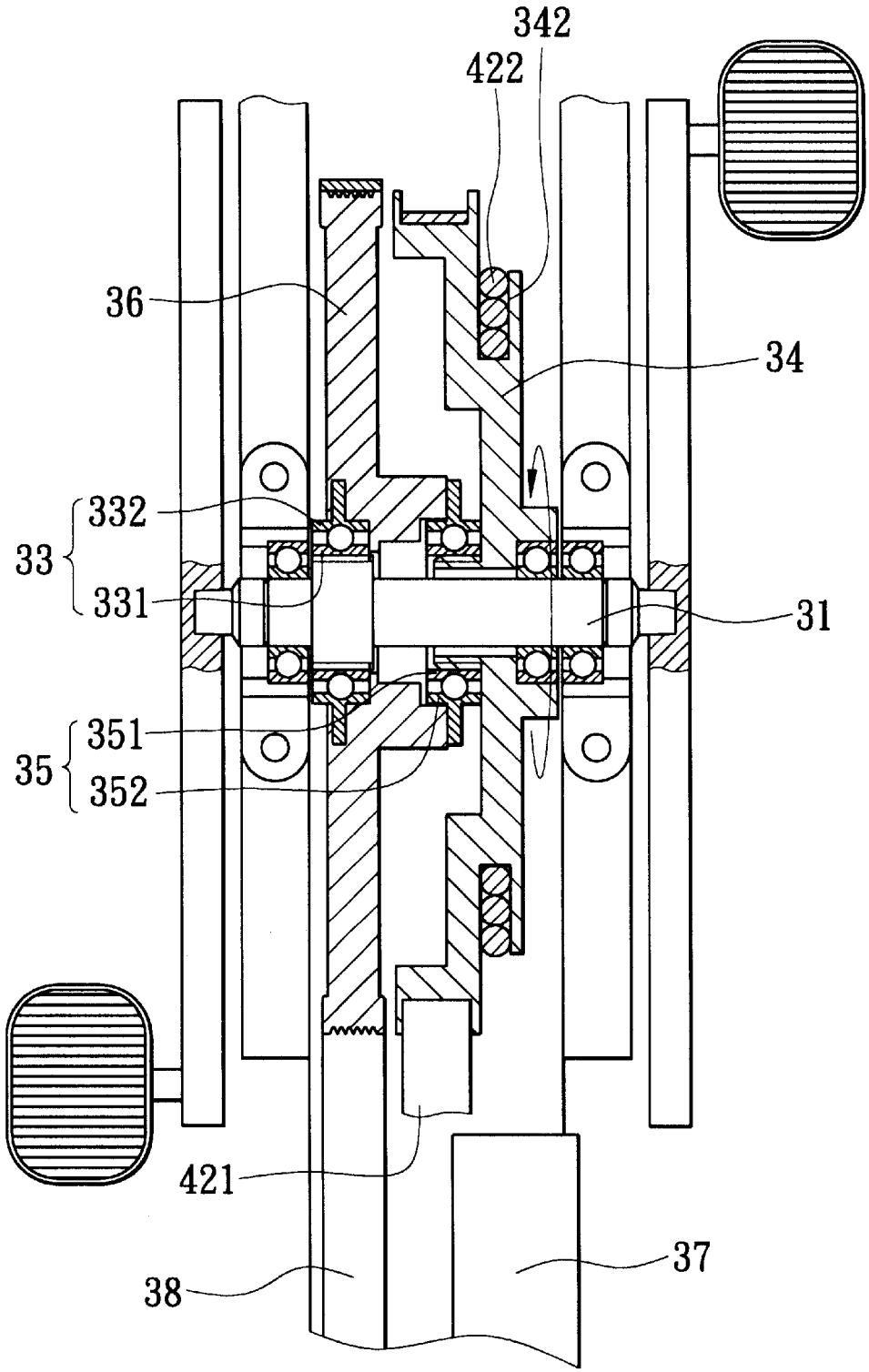
FIG. 9 is a fragmentary, partly sectional, schematic top view of the preferred embodiment to illustrate operation in a rowing mode.

The resistance wheel 37 is disposed between and is mounted rotatably on the upright plates 116. The drive belt 38 is trained on the drive wheel 36 and the resistance wheel 37 such that rotation of the drive wheel 36 is transmitted to the resistance wheel 37. The pull wheel 34 is mounted rotatably on the axle 31. As best shown in FIG. 6, the second one-way clutch 35 includes an inner race 351 secured to the pull wheel 34, and an outer race 352 secured to the drive wheel 36. The second one-way clutch 35 interconnects the pull wheel 34 and the drive wheel 36 such that rotation of the pull wheel 34 in the first or counterclockwise direction results in corresponding rotation of the drive wheel 36 in the first direction, as best shown in FIG. 9, and such that the pull wheel 34 is incapable of driving rotation of the drive wheel 36 when the pull wheel 34 rotates in the second or clockwise direction.

Figure 3:
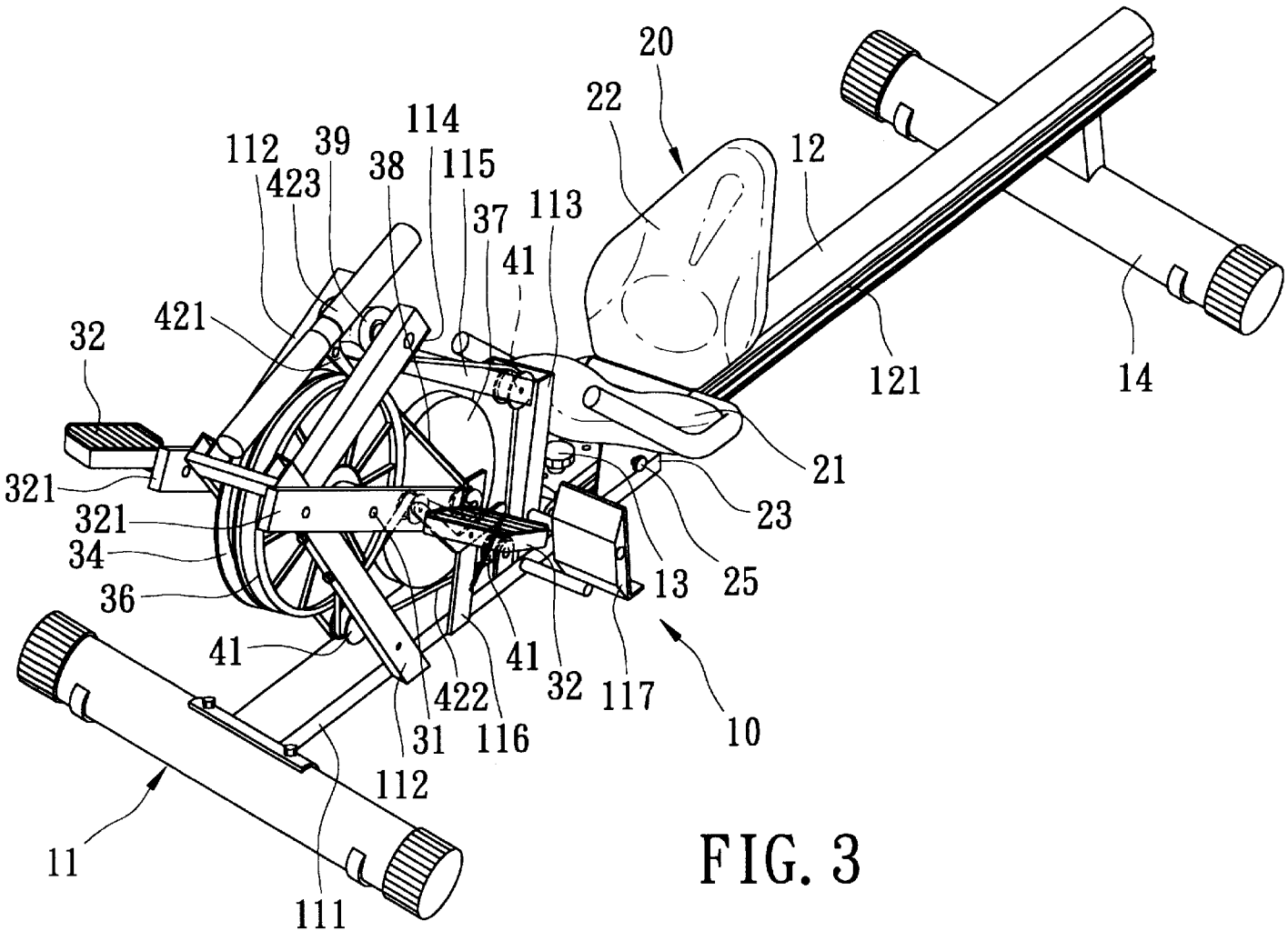
FIG. 3 is a perspective view of the preferred embodiment of a dual-purpose exerciser according to the present invention.

As shown in FIGS. 3, 4 and 6, the pull wheel 34 is formed with first and second annular grooves 341, 342. The pull rope 421 is connected to a pull handle 423 at one end, is trained on a guide roller 39 that is mounted rotatably on the upper ends of the support members 112 and that is disposed above the pull wheel 34, is wound on the pull wheel 34 in the first annular groove 341, and is secured to the pull wheel 34 at the other end. Pulling of the pull handle 423 to unwind the pull rope 421 from the pull wheel 34 drives rotation of the pull wheel 34 in the first direction, as best shown in FIG. 9.

Referring once again to FIGS. 3 and 4, the restoring unit includes a set of guide rollers 41 and an elastic cord 422. The guide rollers 41 are mounted rotatably and respectively on a rear end of the connecting rod 115, on top of the frame member 111, and the lower end of one of the support members 112. The elastic cord 422 has a first end secured to the connecting plate 114 of the front frame section 11, a second end secured to the pull wheel 34 in the second annular groove 342, and an intermediate part between the first and second ends of the elastic cord 422 and trained on the second guide rollers 41. The restoring unit acts to rotate the pull wheel 34 in the second or clockwise direction to wind the pull rope 421 on the pull wheel 34 when the pull rope 421 is released.

Figure 8:
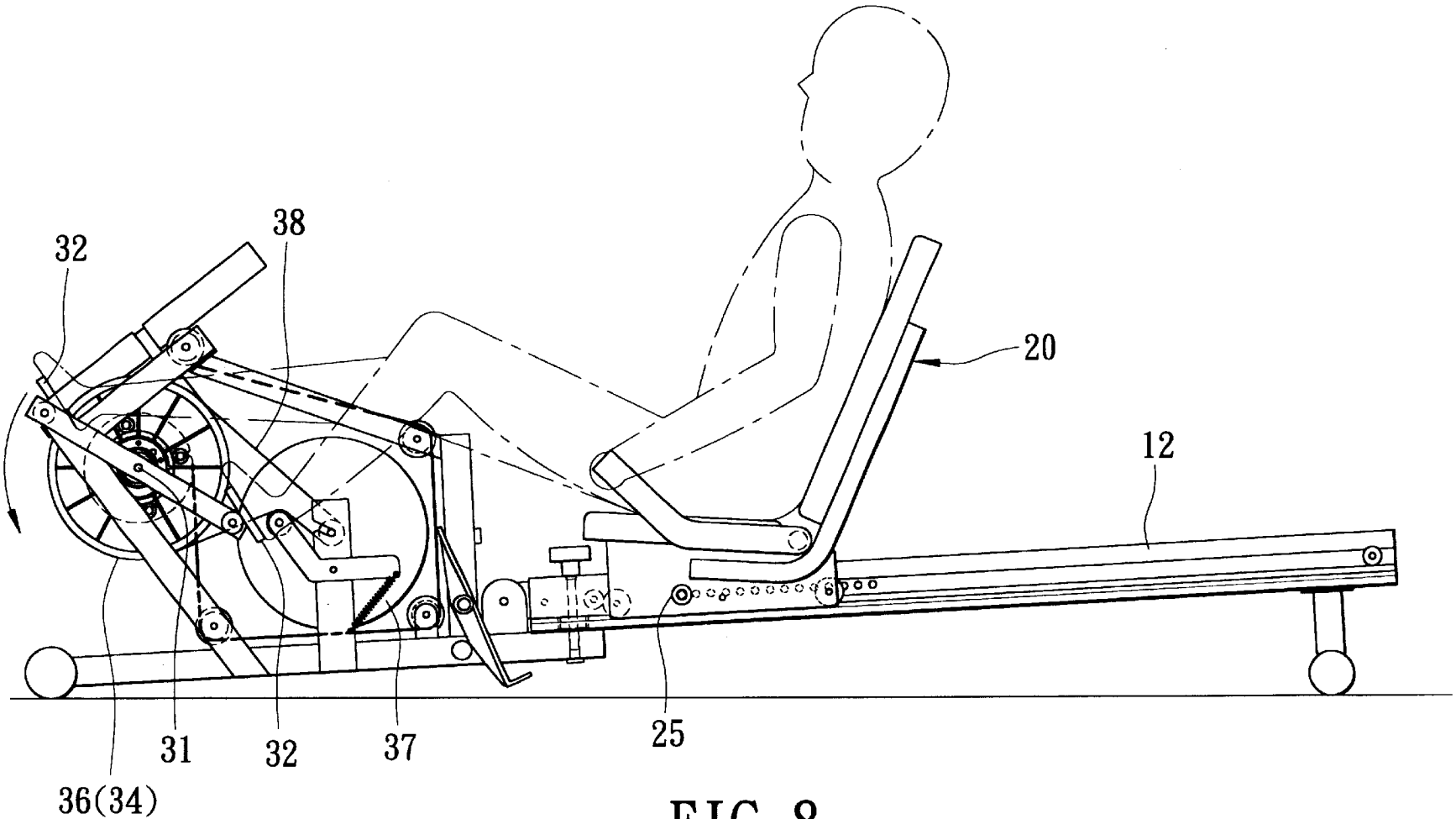
FIG. 8 is a schematic view of the preferred embodiment when operated in the pedaling mode.

Referring now to FIGS. 7 and 8, to operate the dual-purpose exerciser of the present invention in the pedaling mode, the position of the seat 20 is manually adjusted, and the seat 20 is retained at the desired position on the rear frame section 12 with the use of the fastener 25. Thereafter, the user sits on the seat 20 and treads the pedal units 32 in the first or counterclockwise direction. Due to the first one-way clutch 33, the axle 31 will rotate the drive wheel 36 in the first direction so that rotation of the drive wheel 36 is transmitted to the resistance wheel 37 through the drive belt 38. Rotation of the drive wheel 36 in the first direction is not transmitted to the pull wheel 34 due to the second one-way clutch 35. On the other hand, treading of the pedal units 32 in the second or clockwise direction results in idle rotation of the axle 31 by virtue of the first and second one-way clutches 33, 35.

Figure 10:
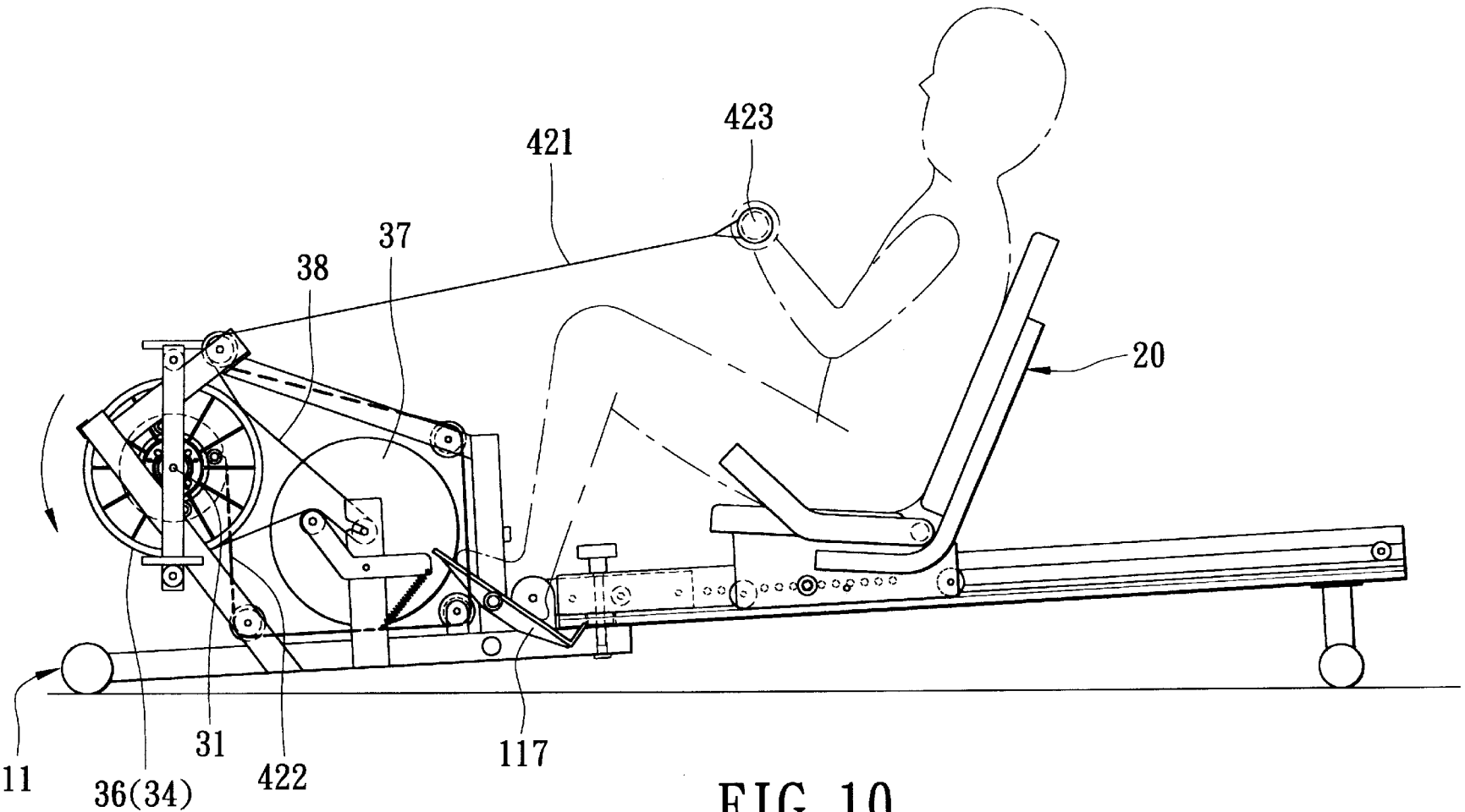
FIG. 10 is a schematic view of the preferred embodiment when operated in the rowing mode.

FIGS. 9 and 10 illustrate the dual-purpose exerciser of the present invention when operated in the rowing mode. After adjusting the position of the seat 20, the user sits on the seat 20 with his feet placed on the footrests 117. The user then pulls the pull handle 423 to unwind the pull rope 421 from the pull wheel 34 against biasing action of the elastic cord 422, thereby driving rotation of the pull wheel 34 in the first or counterclockwise direction. Due to the second one-way clutch 35, the drive wheel 36 will be driven to rotate in the first direction so that rotation of the drive wheel 36 is transmitted to the resistance wheel 37 through the drive belt 38. When the pull handle 423 is released, the elastic cord 422 contracts to rotate the pull wheel 34 in the second or clockwise direction for winding the pull rope 421 on the pull wheel 34. Due to the second one-way clutch 35, rotation of the pull wheel 34 in the second direction is not transmitted to the drive wheel 36.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A dual-purpose exerciser comprising:

an elongate frame unit having a front frame section with front and rear ends, and a rear frame section with front and rear ends, said front end of said rear frame section being connected to said rear end of said front frame section;

a seat mounted on said rear frame section;

an axle mounted rotatably on said front frame section;

a pair of pedal units, each of which has a crank arm coupled to a respective end of said axle, said pedal units being operable so as to drive axial rotation of said axle;

a drive wheel;

a first one-way clutch interconnecting said drive wheel and said axle such that rotation of said axle in a first direction results in corresponding rotation of said drive wheel in the first direction, and such that said axle is incapable of driving rotation of said drive wheel when said axle rotates in a second direction opposite to the first direction;

a resistance wheel mounted rotatably on said front frame section;

a drive belt trained on said drive wheel and said resistance wheel such that rotation of said drive wheel is transmitted to said resistance wheel;

a pull wheel mounted rotatably on said axle;

a second one-way clutch interconnecting said pull wheel and said drive wheel such that rotation of said pull wheel in the first direction results in corresponding rotation of said drive wheel in the first direction, and such that said pull wheel is incapable of driving rotation of said drive wheel when said pull wheel rotates in the second direction;

a pull rope wound on said pull wheel and secured to said pull wheel at one end, wherein pulling of said pull rope to unwind said pull rope from said pull wheel drives rotation of said pull wheel in the first direction; and a restoring unit connected to said pull wheel for rotating said pull wheel in the second direction to wind said pull rope on said pull wheel when said pull rope is released.

2. The dual-purpose exerciser of claim 1, wherein said first one-way clutch includes an inner race secured to said axle, and an outer race secured to said drive wheel.

3. The dual-purpose exerciser of claim 1, wherein said second one-way clutch includes an inner race secured to said pull wheel and an outer race secured to said drive wheel.

4. The dual-purpose exerciser of claim 1, further comprising a pair of foot rests mounted on said rear end of said front frame section.

5. The dual-purpose exerciser of claim 1, wherein said front end of said rear frame section is connected foldably to said rear end of said front frame section.

6. The dual-purpose exerciser of claim 5, further comprising a fastener unit for fastening releasably said rear frame section to said front frame section at a selected one of unfolded and folded positions.

7. The dual-purpose exerciser of claim 1, wherein said seat is slidable along said rear frame section, and said dual-purpose exerciser further comprises a locking unit for locking realeasably said seat against sliding movement on said rear frame section.

8. The dual-purpose exerciser of claim 7, wherein said rear frame section has lateral sides formed with a pair of longitudinally extending rail grooves, respectively, said seat being formed with a pair of roller-mounting plates that flank said rear frame section, each of said roller-mounting plates being provided with a roller unit that engages a respective one of said rail grooves rollingly.

9. The dual-purpose exerciser of claim 8, wherein said locking unit includes a series of positioning holes formed in one of said rail grooves, and a fastener extending through one of said roller-mounting plates and into a selected one of said positioning holes.

10. The dual-purpose exerciser of claim 1, wherein said restoring unit includes a guide roller set mounted on said front frame section, and an elastic cord having a first end secured to said front frame section, a second end secured to said pull wheel, and an intermediate part between said first and second ends of said elastic cord and trained on said guide roller set.

* * * * *